US008814509B2

(12) United States Patent
Moore et al.

(10) Patent No.: US 8,814,509 B2
(45) Date of Patent: Aug. 26, 2014

(54) INTERNALLY-COOLED CENTRIFUGAL COMPRESSOR WITH COOLING JACKET FORMED IN THE DIAPHRAGM

(75) Inventors: James J. Moore, Midlothian, TX (US); Andrew H. Lerche, San Antonio, TX (US); Brian S. Moreland, San Antonio, TX (US)

(73) Assignee: Dresser-Rand Company, Olean, NY (US)

( * ) Notice: Subject to any disclaimer, the term of this patent is extended or adjusted under 35 U.S.C. 154(b) by 609 days.

(21) Appl. No.: 12/930,751

(22) Filed: Jan. 14, 2011

(65) Prior Publication Data

US 2012/0063882 A1 Mar. 15, 2012

Related U.S. Application Data

(60) Provisional application No. 61/402,983, filed on Sep. 9, 2010.

(51) Int. Cl.
*F04D 29/58* (2006.01)
*F04D 29/44* (2006.01)
*F04D 1/06* (2006.01)

(52) U.S. Cl.
USPC ..... 415/179; 415/199.2

(58) Field of Classification Search
USPC ..... 415/175–180, 199.1–199.3, 415/208.2–208.4, 165; 165/86, 88, 92, 125
See application file for complete search history.

(56) References Cited

U.S. PATENT DOCUMENTS

| | | | | | |
|---|---|---|---|---|---|
| 1,653,217 | A | * | 12/1927 | Koch | 415/179 |
| 1,857,486 | A | * | 5/1932 | Trumpler | 415/179 |
| 2,380,772 | A | * | 7/1945 | McMahan | 415/187 |
| 2,384,251 | A | * | 9/1945 | Hill | 415/178 |
| 2,474,410 | A | * | 6/1949 | Aue | 415/179 |
| 2,612,310 | A | * | 9/1952 | Eggmann | 415/179 |
| 3,205,828 | A | * | 9/1965 | Rupp | 415/199.1 |
| 3,241,743 | A | * | 3/1966 | Laing et al. | 416/176 |
| 3,295,597 | A | * | 1/1967 | Laing et al. | 165/86 |
| 3,424,234 | A | * | 1/1969 | Laing | 165/89 |
| 4,271,682 | A | * | 6/1981 | Seki | 62/354 |
| 5,361,828 | A | * | 11/1994 | Lee et al. | 165/109.1 |
| 5,674,053 | A | | 10/1997 | Paul et al. | |
| 6,203,275 | B1 | * | 3/2001 | Kobayashi et al. | 415/199.2 |

(Continued)

FOREIGN PATENT DOCUMENTS

JP 06294398 A * 10/1994 ..... F04D 29/58

OTHER PUBLICATIONS

Machine Translation of JP 06-294398 dated Apr. 8, 2013.*

(Continued)

*Primary Examiner* — Nathaniel Wiehe
*Assistant Examiner* — Wayne A Lambert
(74) *Attorney, Agent, or Firm* — Edmonds & Nolte, PC

(57) ABSTRACT

An internally-cooled centrifugal compressor having a shaped casing and a diaphragm disposed within the shaped casing having a gas side and a coolant side so that heat from a gas flowing though the gas side is extracted via the coolant side. An impeller disposed within the diaphragm has a stage inlet on one side and a stage outlet for delivering a pressurized gas to a downstream connection. The coolant side of the diaphragm includes at least one passageway for directing a coolant in a substantially counter-flow direction from the flow of gas through the gas side.

14 Claims, 5 Drawing Sheets

(56) References Cited

U.S. PATENT DOCUMENTS

| | | | | |
|---|---|---|---|---|
| 6,345,503 | B1 * | 2/2002 | Gladden | 60/612 |
| 6,790,014 | B2 | 9/2004 | Bowen | |
| 2004/0055740 | A1 * | 3/2004 | Meshenky et al. | 165/125 |
| 2009/0028730 | A1 * | 1/2009 | Radermacher et al. | 417/423.8 |

OTHER PUBLICATIONS

Novel Concepts for the Compression of Large Volumes of Carbon Dioxide—Phase II Quarterly Progress Report Jul. 1, 2008 thru Sep. 30, 2008.

Novel Concepts for the Compression of Large Volumes of Carbon Dioxide—Phase II Quarterly Progress Report Oct. 1, 2008 thru Dec. 31, 2008.

Novel Concepts for the Compression of Large Volumes of Carbon Dioxide—Phase II Quarterly Progress Report Jan. 1, 2009 thru Mar. 31, 2009.

Novel Concepts for the Compression of Large Volumes of Carbon Dioxide—Phase II Quarterly Progress Report Apr. 1, 2009 thru Jun. 30, 2009.

Novel Concepts for the Compression of Large Volumes of Carbon Dioxide—Phase II Quarterly Progress Report Jul. 1, 2009 thru Sep. 30, 2009.

Novel Concepts for the Compression of Large Volumes of Carbon Dioxide—Phase II Quarterly Progress Report Oct. 1, 2009 thru Dec. 31, 2009.

Novel Concepts for the Compression of Large Volumes of Carbon Dioxide—Phase II Quarterly Progress Report Jan. 1, 2010 thru Mar. 31, 2010.

Novel Concepts for the Compression of Large Volumes of Carbon Dioxide—Phase II Quarterly Progress Report Apr. 1, 2010 thru Jun. 30, 2010.

Novel Concepts for the Compression of Large Volumes of Carbon Dioxide—Phase II Quarterly Progress Report Jul. 1, 2010 thru Sep. 30, 2010.

Novel Concepts for the Compression of Large Volumes of Carbon Dioxide—Phase II Final Progress Report Covering Periods Jun. 30, 2008 thru Dec. 30, 2010 This report is cumulative of Quarterly Reports 1-9 listed above.

* cited by examiner

INTERNALLY-COOLED CENTRIFUGAL COMPRESSOR WITH COOLING JACKET FORMED IN THE DIAPHRAGM

CROSS-REFERENCE TO RELATED APPLICATIONS

This application claims priority to U.S. Provisional Patent Application Ser. No. 61/402,983, filed Sep. 9, 2010.

STATEMENT OF GOVERNMENT INTEREST

This invention was made with government support under Government Contract No. DE-FC26-05NT42650 awarded by the US Department of Energy. The government has certain rights in the invention.

TECHNICAL FIELD

Embodiments of the disclosure are generally related to systems for isothermal compression. Specific embodiments of the disclosure relate to an internally-cooled centrifugal compressor with greatly increased heat transfer properties. A more specific embodiment of the disclosure relates to a compressor utilizing a cooled diaphragm section with internal cooling passages through the diffuser and return channel vanes such that cooling flows in a substantially counter-flow direction of gas flow.

BACKGROUND OF THE DISCLOSURE

Compressors are well known in the art with their primary function being to increase the pressure of a gas. It is also well known that compression of a gas not only increases pressure, but also causes heating of the gas by the work of compression. Thus, a gas is considerably hotter at the discharge than at the inlet of the compressor. In multistage compressors, for subsequent stages, this increase in heat (or temperature) requires greater heat rise for a given pressure ratio, which requires more power than compressing a cool gas.

Isothermal compression has been used as a way of maintaining a constant temperature during the gas compression process which, in turn, reduces the compression power required. However, typical isothermal compression processes will compress the gas in steps with intercooling between these steps with the downside of increased complexity and size of the compressor apparatus.

Thus, a need exists for an efficient means of compressing a gas that maximizes heat transfer while also minimizing aerodynamic pressure losses. A means of achieving isothermal compression of a gas without the size and piping requirements of prior art isothermal compressors would provide numerous advantages.

SUMMARY OF THE DISCLOSURE

The following summary is provided to facilitate an understanding of some of the innovative features unique to the present disclosure and is not intended to be a full description. A full appreciation of the various aspects of the embodiments disclosed herein can be gained by taking the entire specification, claims, drawings, and abstract as a whole.

It is, therefore, one aspect of the present disclosure to provide for an improved compressor apparatus. It is another aspect of the present disclosure to provide for an internally-cooled compressor that allows isothermal compression of a gas. It is a further aspect of the present disclosure to provide for an improved isothermal compressor that maximizes heat transfer while not introducing additional aerodynamic losses in the gas flow path. It should be noted that the term "isothermal" also includes operation at a semi-isothermal capacity, without departing from the scope of the disclosure.

The aforementioned aspects and other objectives and advantages can now be achieved as described herein. Briefly, disclosed is an isothermal compressor with a cooling jacket structure formed in the diaphragm of the compressor. With the isothermal compressor of the present disclosure, cooling flow is routed through both the diffuser and return channel vanes and the bulb section of the diaphragm as a working fluid or gas is compressed through the diffuser and return channel. In one embodiment, heat transfer is achieved using diffuser vanes with internal cooling holes through which the cooling flow is channeled. The vanes also serve to increase pressure recovery in the diffuser. The return channel vanes may also define cooling holes that feed cooling flow into a hollow plenum arranged inside the center bulb. As the gas passes by the cooling flow coursing through the cooling holes of both the diffuser and return channel vanes and the center bulb, heat is extracted from the working fluid without additional drop in pressure for the gas.

In one embodiment, the walls for the gas flow path are maintained smooth while the flow path for the cooling fluid is roughened in order to maximize turbulence and heat transfer. Accordingly, in at least one embodiment, all of the cooling holes defined within the diffuser and return channel vanes may be roughened to increase heat transfer. Surface roughness may be achieved by tapping a screw thread in each hole.

According to still another embodiment, an isothermal compressor is disclosed that has an internally-cooled diaphragm with large structural vanes that increase the strength of the diaphragm and also increase the turbulence of cooling liquid flow resulting in improved heat transfer.

Embodiments of the disclosure generally provide an internally-cooled centrifugal compressor. The compressor may include a shaped casing having a stage inlet for an upstream gas connection and a stage outlet for a downstream gas connection, and a diaphragm arranged within said shaped casing and having a gas side and a coolant side so that heat from a gas flowing through the gas side is extracted via said coolant side, wherein, the coolant side includes a cooling agent flow path for directing a cooling agent in a substantially counter-flow direction from a flow of the gas through the gas side.

Embodiments of the disclosure may further provide an internally-cooled centrifugal compressor diaphragm. The compressor may include a rotatable impeller centrally-disposed within the diaphragm, a diffuser fluidly coupled to an outlet of the impeller and having a plurality of diffuser vanes arranged therein, each diffuser vane having at least one diffuser conduit defined therein, and a return channel fluidly coupled to the diffuser and having a plurality of return channel vanes arranged therein, each return channel vane having at least one return conduit defined therein. The compressor may further include a cooling jacket proximally-located about the diffuser and the return channel, the cooling jacket having a first chamber and a second chamber, and a center bulb defined within the diaphragm and interposed between the diffuser and the return channel, the center bulb being in fluid communication with the first chamber via the at least one return conduit and in fluid communication with the second chamber via the at least one diffuser conduit.

Embodiments of the disclosure may further provide a method of cooling a working fluid in a centrifugal compressor. The method may include circulating the working fluid through a diffuser having a plurality of diffuser vanes arranged therein, each diffuser vane having at least one diffuser conduit defined therein, receiving the working fluid in a return channel fluidly coupled to the diffuser and having a plurality of return channel vanes arranged therein, each return channel vane having at least one return conduit defined therein, circulating a cooling agent from a first chamber into a center bulb interposed between the diffuser and the return channel, the first chamber being located adjacent the return channel and in fluid communication with the center bulb via the at least one return conduit, and circulating the cooling agent from the center bulb to a second chamber, the second chamber being located adjacent the diffuser and in fluid communication with the center bulb via the at least one diffuser conduit, whereby as the cooling agent is circulated it removes heat from the working fluid.

BRIEF DESCRIPTION OF THE DRAWINGS

The accompanying figures, in which like reference numerals refer to identical or functionally-similar elements throughout the separate views and which are incorporated in and form a part of the specification, further illustrate the present disclosure and, together with the detailed description of the disclosure, serve to explain the principles of the present disclosure.

DETAILED DESCRIPTION

Figure 1:
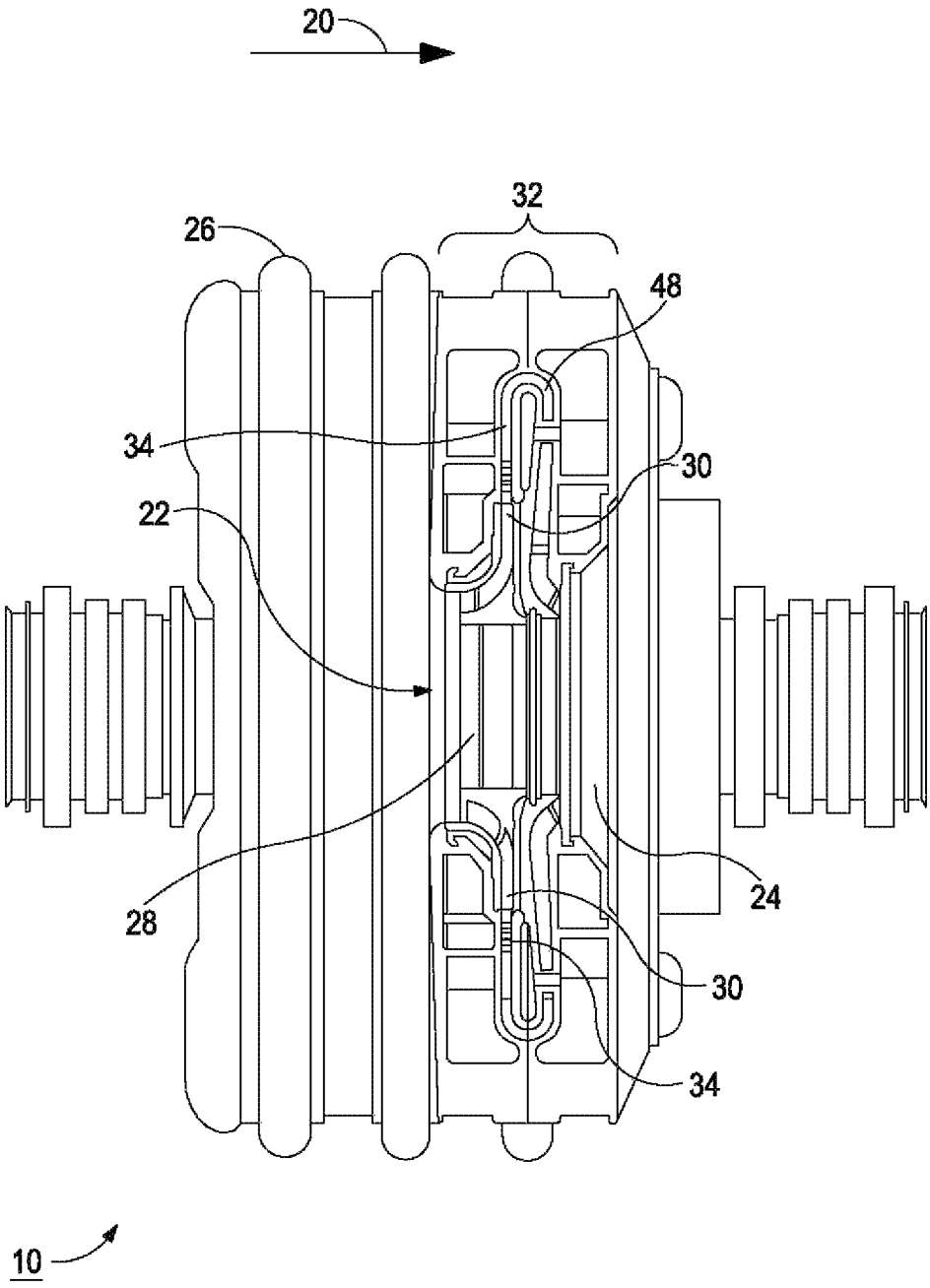
FIG. 1 is a cross-section view of a centrifugal compressor with an internally-cooled diaphragm according to one embodiment.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring to FIG. 1, a cross-sectional view of a centrifugal compressor according to one or more embodiments is shown and denoted generally as 10. The compressor 10 may be used to compress a gas or working fluid. Although the compressor 10 is shown with only one stage, it will appreciated that the compressor 10 can be utilized in a multi-stage configuration where substantially similar compressor stages are coupled together axially with each stage providing a cooler gas to a subsequent downstream stage.

There are many applications for the use of a centrifugal compressor 10 such as, for example, the compression of $CO_2$ associated with carbon capture and sequestration projects and other similar attempts to reduce emissions while conserving energy. As will be described herein, the compressor 10 provides significant reduction in the required power associated with compression of all gases, including $CO_2$, by performing near or at isothermal compression. Accordingly, the compressor 10 may reduce the need for intercoolers or eliminate the need for intercoolers altogether.

In exemplary operation, the gas travels through the compressor 10 generally in the direction of arrow 20 from a stage inlet 22 to a stage outlet 24. The stage inlet 22 provides a pipe connection from a source of gas to a housing or shaped casing 26 containing the various compressor components. Likewise, stage outlet 24 provides a pipe connection to a downstream system for receiving the pressurized gas. The compressor 10 includes a rotating impeller 28 arranged within the shaped casing 26 and configured to force the gas to the tip 30 of the impeller 28, thereby increasing the velocity of the gas entering the diffuser 34. A diaphragm section (or "diaphragm" as the terms shall be used interchangeably) 32 includes all of the various components contained within the back half or downstream end of the shaped casing 26 and forms the gas flow path of compressor 10. In particular, the diaphragm 32 includes a diffuser 34 fluidly coupled to a return channel 48. The diffuser 34 is configured to convert the velocity energy of the gas received from the impeller 28 to pressure energy, resulting in the compression of the gas. The return channel 48 is configured to receive the compressed gas from the diffuser 34 and eject the compressed gas from the gas flow path via the stage outlet 24, or otherwise inject the compressed gas into a succeeding compressor stage (not shown).

Figure 2A:
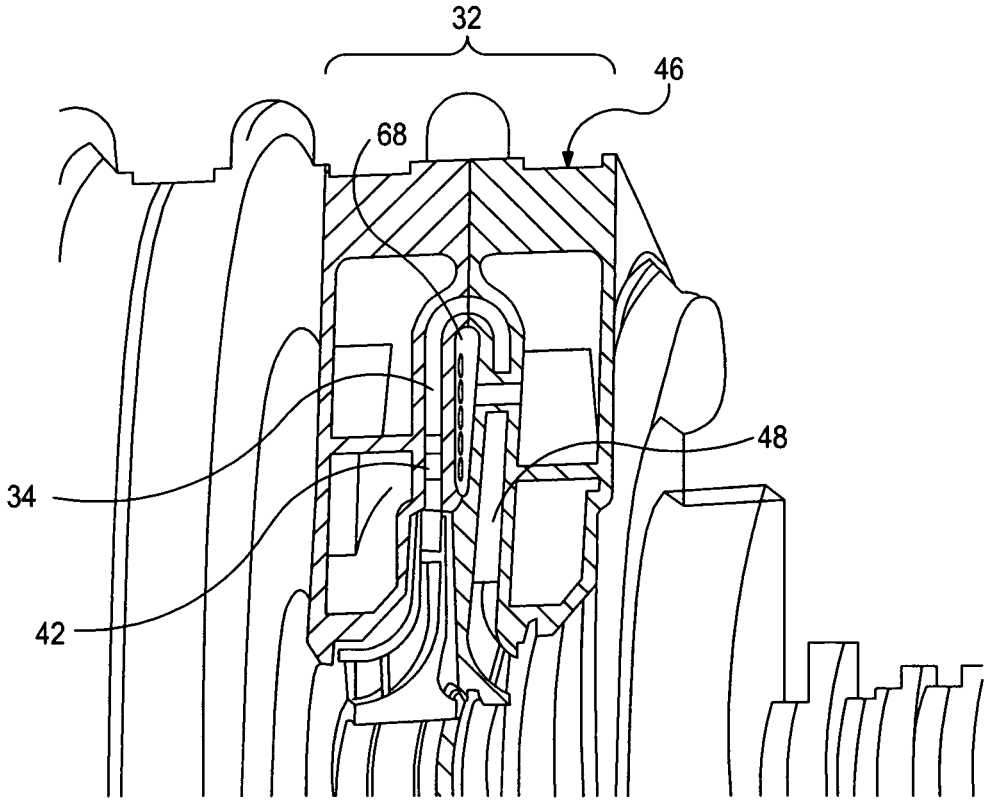
FIGS. 2*a* and 2*b* are cross-section close up views of the internally-cooled diaphragm in accordance with an embodiment.
Figure 2B:
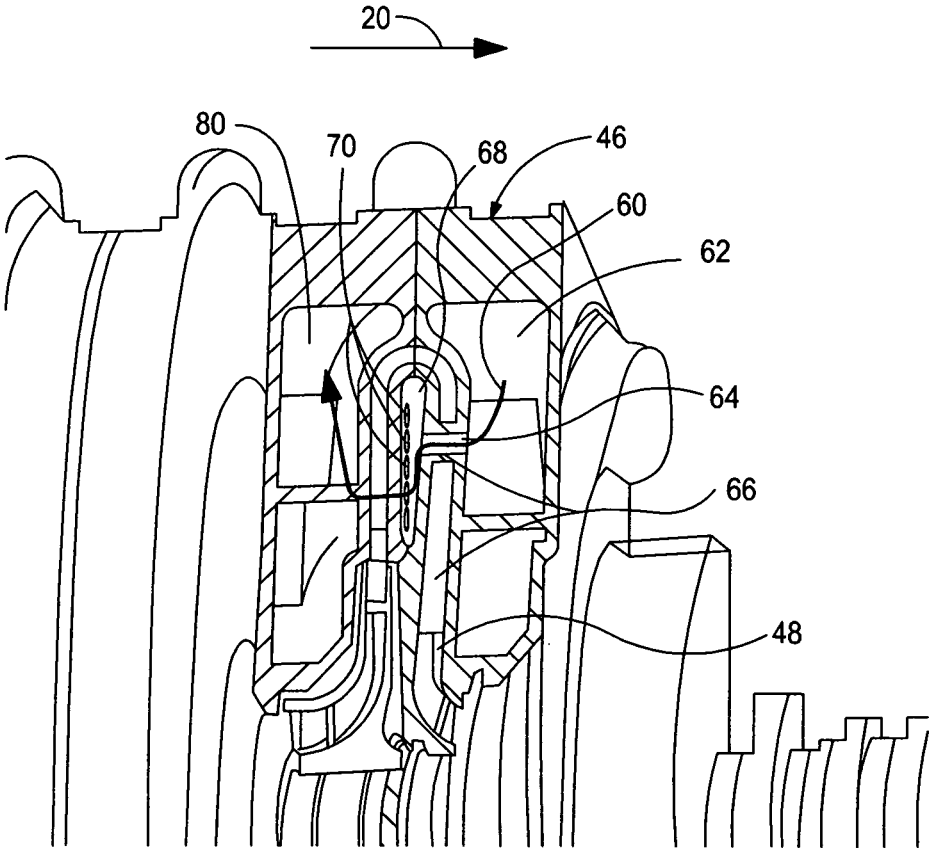

Referring now to FIGS. 2*a* and 2*b*, the diaphragm 32 includes a plurality of diffuser vanes 42 are arranged within the diffuser 34, and a plurality of return channel vanes 66 are arranged within the return channel 48. Moreover, the diaphragm 32 encompasses both a gas side and a coolant side. As illustrated in FIG. 2*a*, the gas side may generally refer to or include the gas passageway defined by a combination of the diffuser 34 and the return channel 48. On the other hand, the coolant side may generally include a cooling jacket 46 proximally-located about or otherwise surrounding the gas side (i.e., adjacent both the diffuser 34 and the return channel 48). As will be described in more detail below with reference to FIG. 2*b*, the coolant side may further include a center bulb 68. The cooling jacket 46 forms a barrier through which a cooling agent can flow for extracting heat from the pressurized gas flowing through the diffuser 34 and the return channel 48. According to the disclosure, the fact that the cooling jacket 46 is contained within the diaphragm 32 of the compressor 10 provides an efficient way of extracting heat from the pressurized gas flowing in the gas side.

As shown in FIG. 2*b*, the cooling agent may be configured to follow a flow path represented by arrow 60, which generally follows a substantially counter-flow path in a direction similar to, for example, a counter-flow heat exchanger. In particular, the cooling agent flow direction 60 may be substantially opposite that of the gas flow direction 20. In one embodiment, the cooling agent flow path 60 may originate in a first or right chamber 62 defined by the cooling jacket 46. From the right chamber 62, the cooling agent may be fed through one or more return conduits 64 defined or otherwise formed in the return channel vanes 66 of the return channel 48. The return conduits 64 may feed the cooling agent into a center bulb 68 defined by the diaphragm 32. The center bulb 68 may include a plenum adapted to feed the cooling agent into one or more diffuser conduits 70 defined or otherwise formed in the diffuser vanes 42 (see FIG. 2*b*). The cooling agent is ultimately gathered in a second or left chamber 80 defined by the cooling jacket 46. From the left chamber 80, the cooling agent exits the compressor 10 to be eventually recirculated back to the right chamber 62 in order to start the cooling agent flow path over again.

In one or more embodiments, the cooling agent may include a coolant, such as ambient water, chilled water or ethylene glycol. It will be appreciated, however, that the cooling agent is not limited to liquids only, as gases could also be used as a suitable coolant source. In one embodiment, the cooling agent exiting the left chamber 80 may be circulated through one or more heat exchangers before being reintroduced in the right chamber 62.

Figure 3:
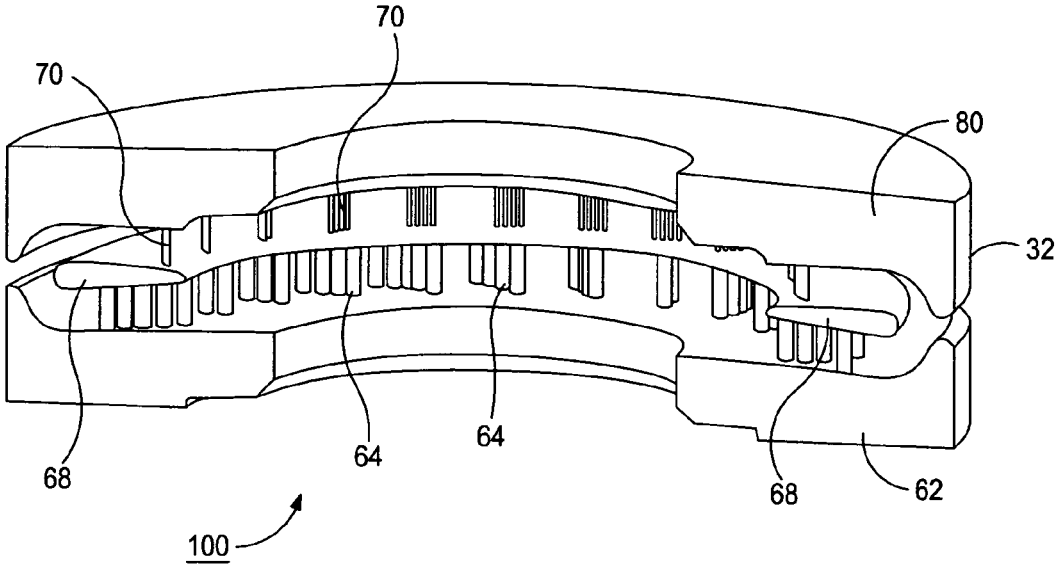
FIG. 3 illustrates the domain of the cooling flow in accordance with an embodiment.

Referring now to FIG. 3, the domain in which the cooling agent is made to flow is shown and denoted generally as 100. As illustrated, the right chamber 62 is fluidly coupled to the left chamber 80 via a network of return and diffuser conduits 64, 70 and the center bulb 68.

It has been found that maximizing the surface area of the cooling domain 100 provides the most efficient transfer of heat from the pressurized gas flowing in the gas side to the cooling agent flowing in the coolant side. Consequently, the surface area of the cooling domain 100 is maximized through the implementation of return conduits 64 and diffuser conduits 70 within the return channel vanes 66 and diffuser vanes 42, respectively. In this way, an internal means of heat extraction is provided to a single stage or multi-stage compressor apparatus, such as the compressor 10 described herein.

It should be understood that the present disclosure is not limited to a particular configuration of diaphragm, such as the diaphragm 32 described herein. Instead, the current disclosure encompasses unique and novel aspects relating to the efficient operation of a compressor, such as compressor 10, where internal cooling is provided by maximizing the surface area of the cooling domain side of the diaphragm section 32 inside the compressor 10 without negatively impacting gas pressure. Thus, Applicants of the present disclosure have discovered that various features can be utilized within the diaphragm section 32 to improve efficiency and avoid negative impacts on compressor 10 performance.

One such feature involves the physical aspects of the diaphragm section 32. For example, it has been discovered by Applicants that maintaining the gas flow path within a substantially smooth-walled structure while directing the cooling agent through a cooling agent flow path having a roughened-walled structure maximizes turbulence in the coolant side and heat transfer while keeping pressure drop on the gas side identical to a standard (non-cooled) compressor design. As used herein, a "smooth-walled structure" generally refers to a diaphragm 32 that has not been intentionally roughened, i.e., does not create significant turbulence with the gas/fluid flowing thereby, so as to result in a diaphragm 32 having walls that are coarse, jagged, or rugged. Moreover, as used herein, a "roughened-walled structure" includes, but is not limited to, threading the return and diffuser conduits 64, 70 so as to generate coarsely threaded holes that make a tortuous flow path for the cooling agent flowing therethrough. The term "roughened-walled structure" may also include or otherwise refer to the implementation or addition of structural vanes 160 within the coolant side of the diaphragm 32, as will be described in more detail below with reference to FIG. 5.

The diaphragm 32, including the cooling jacket 46, center bulb 68, diffuser vanes 42, and return channel vanes 66, may be manufactured via a variety of manufacturing processes. For example, in one manufacturing process the diaphragm 32 is fabricated by first machining the individual components, such as by computer numerically controlled (CNC) milling techniques. The machined pieces may then be welded together, heat treated, and then final-machined to smooth each weldment. Because of the complexity of the diaphragm 32 and its components, the diaphragm 32 may be machined and welded throughout multiple stages. For instance, the bulb 68 pieces may be machined in two sections; one section containing the diffuser vanes 42, and the other section containing the return channel vanes 66. These two sections can be welded together to complete the bulb section 68. Moreover, the main structural sections of the cooling jacket 46 may also be machined using two pieces for each half; one piece for the diffuser vane side and another for the return channel side. These two sections may be welded to the bulb section 68 at both the diffuser and return channel vanes 42,66, and may then be welded to each other at the perimeter.

It will be appreciated, however, that other forms of manufacturing may be employed, without departing from the scope of the disclosure. For example, it is also contemplated herein to cast the diaphragm 32 as a single component, such as by sand casting, plaster mold casting, investment casting, or die casting.

Figure 4:
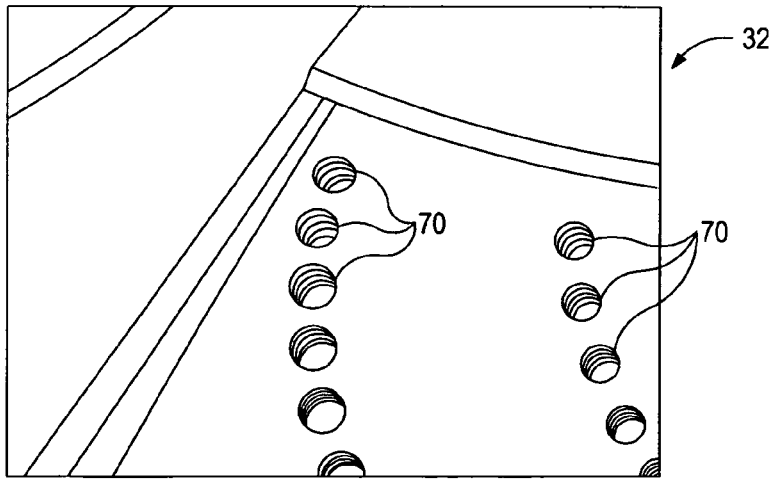
FIG. 4 is a close up view showing roughness in cooling holes.

Referring to FIG. 4, illustrated is a portion of the coolant side of the diaphragm 32 showing a plurality of diffuser conduits 70 having coarsely drawn threads defined therein. It will be appreciated that the diffuser conduits 70 shown in FIG. 4 may equally be depicted as return conduits 64 which are substantially similar, but not necessarily geometrically identical, to the diffuser conduits 70. The use of coarsely threaded holes increases the turbulence of the cooling agent flowing therein and also increases the surface area of each conduit 64 or 70. Consequently, the overall heat transfer from the gas in the gas side to the coolant side is enhanced. In at least one embodiment, threading the conduits 64 or 70 may also prove advantageous by simplifying the manufacturing process as compared to other turbulence generators.

Figure 5:
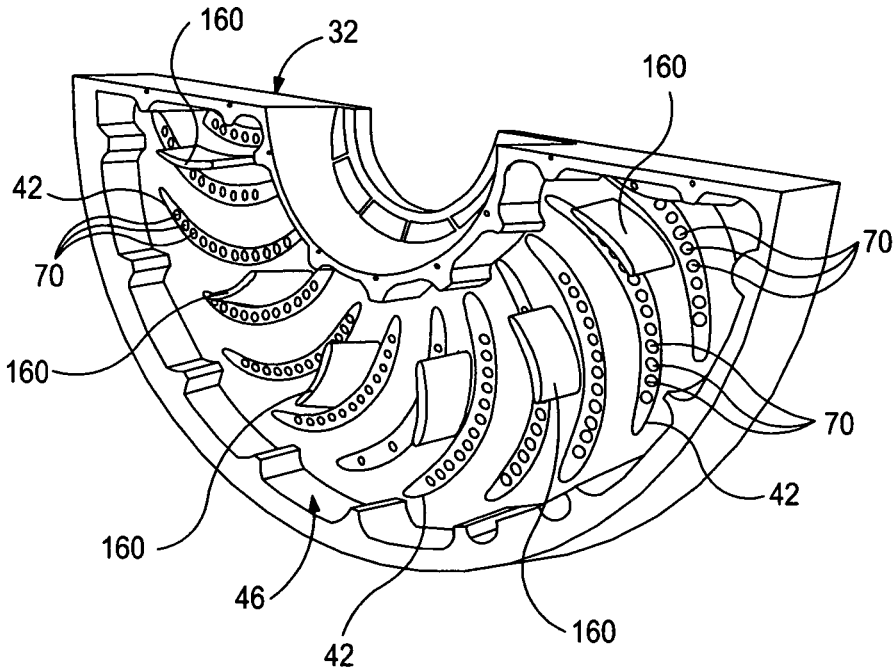
FIG. 5 is a representative picture of an internally-cooled diaphragm according to one embodiment.

FIG. 5 is a pictorial representation of one half of an exemplary diaphragm 32 showing a portion of the inside of the cooling jacket 46. Also illustrated is a plurality of diffuser conduits 70. It will be appreciated that the diffuser conduits 70 shown in FIG. 5 may equally be depicted as return conduits 64 which, as described above, are substantially similar, but not necessarily geometrically identical, to the diffuser conduits 70. In an embodiment, the cooling jacket 46 may include one or more large structural vanes 160 that may be used to both increase the strength of the diaphragm 32 and also increase the turbulence of the cooling agent flowing therein, thereby increasing the heat transfer in this region. In operation, the structural vanes 160 may minimize the shearing of the diaphragm 32 under pressure loading and may be positioned so as not to interfere with the slot welding of the diffuser vanes 42 (or return channel vanes 66, in the event return conduits 64 are shown). While only six structural vanes 160 are shown, it will be appreciated that any number of structural vanes 160 may be used, without departing from the scope of the disclosure.

Figure 6:
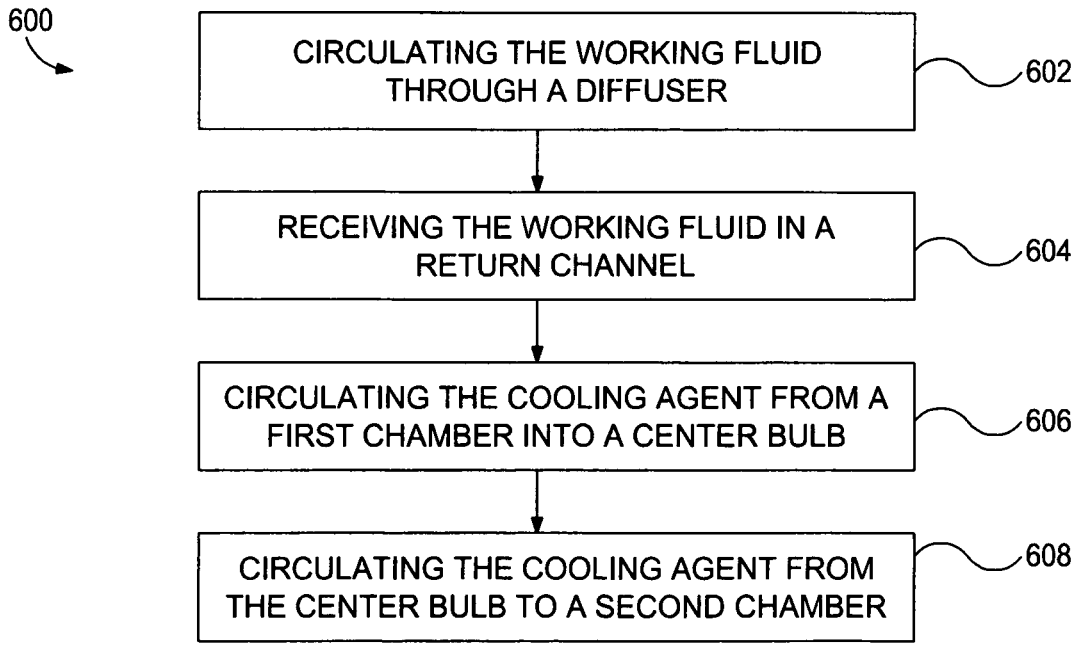
FIG. 6 is a schematic of a method of cooling a gas or working fluid being compressed in a centrifugal compressor.

Referring now to FIG. 6, illustrated is a schematic of a method 600 of cooling a gas or a working fluid being compressed in a centrifugal compressor. The method 600 may include circulating the working fluid through a diffuser, as at 602. In one embodiment, the diffuser has a plurality of diffuser vanes arranged therein, and each diffuser vane has at least one diffuser conduit defined therein for the circulation of a cooling agent. The working fluid may be received in a return channel, as at 604. The return channel may be fluidly coupled to the diffuser and have a plurality of return channel vanes arranged therein. Similar to the diffuser vanes, each return channel vane may have at least one return conduit defined therein for the circulation of the cooling agent.

A cooling agent may then be circulated from a first chamber into a center bulb, as at 606. The center bulb may be interposed between the diffuser and the return channel, and the first chamber may be adjacent to or otherwise surrounding the return channel on at least one side thereof. Moreover, the first chamber may be in fluid communication with the center bulb via the return conduits defined within the return channel vanes. The cooling agent may further be circulated from the center bulb to a second chamber, as at 608. The second chamber may be located adjacent to or otherwise surrounding the diffuser on at least one side thereof. Furthermore, the second chamber may be in fluid communication with the center bulb via the diffuser conduits defined within the diffuser vanes.

Accordingly, as the cooling agent is circulated from the first chamber to the center bulb, and from the center bulb to the second chamber, heat is constantly being transferred from the working fluid to the cooling agent, thereby resulting in the overall cooling of the working fluid. As will be appreciated, the heat transfer may occur within the return vanes or diffuser vanes as the cooling agent passes therethrough, but may also occur within the first and second chambers as heat is passed from the return channel and diffuser into the first and second chambers, respectively. Moreover, heat transfer may occur in the cooling agent flowing in the center bulb.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An internally-cooled centrifugal compressor, comprising:

a shaped casing having a stage inlet for an upstream gas connection and a stage outlet for a downstream gas connection; and a diaphragm arranged within said shaped casing and having a gas side and a coolant side so that heat from a gas flowing through the gas side is extracted via said coolant side, wherein the coolant side includes a cooling agent flow path for directing a cooling agent in a substantially counter-flow direction from a flow of the gas through the gas side, wherein the gas side of the diaphragm comprises: a diffuser having a plurality of diffuser vanes arranged therein, the diffuser being proximally located near the coolant side of the diaphragm so that the heat in the gas can be extracted by the cooling agent flowing through said coolant side; and a return channel fluidly coupled to the diffuser and having a plurality of return channel vanes arranged therein, the return channel being configured to deliver a pressurized gas to the stage outlet of the diaphragm, and wherein the coolant side of the diaphragm comprises: a first chamber from which the cooling agent originates; a center bulb defined by the diaphragm and interposed between the diffuser and the return channel, the center bulb including a plenum in fluid communication with the first chamber via one or more return conduits defined within the plurality of return channel vanes, wherein the cooling agent flows from the first chamber into the plenum of the center bulb; and a second chamber in fluid communication with the plenum of the center bulb via one or more diffuser conduits defined within the plurality of diffuser vanes, wherein the cooling agent flows from the plenum of the center bulb into the second chamber.

2. The internally-cooled centrifugal compressor of claim 1, further comprising an impeller disposed within said diaphragm, the impeller having a first side fluidly coupled to the stage inlet for receiving the gas from the upstream gas connection and delivering the gas to said impeller, and a second side fluidly coupled to said stage outlet for delivering the pressurized gas to the downstream gas connection through said stage outlet.

3. The internally-cooled centrifugal compressor of claim 1, wherein the return conduits and/or the diffuser conduits are coarsely threaded.

4. The internally-cooled centrifugal compressor of claim 1, wherein the first chamber and/or the second chamber of the coolant side is formed of a roughened-walled structure.

5. The internally-cooled centrifugal compressor of claim 1, wherein said gas side of said diaphragm is formed of a smooth-walled structure.

6. The internally-cooled centrifugal compressor of claim 1, wherein the first chamber and/or the second chamber have a plurality of structural vanes arranged therein to generate turbulence of the cooling agent.

7. The internally-cooled centrifugal compressor of claim 1, wherein the cooling agent is a liquid coolant.

8. The internally-cooled centrifugal compressor of claim 1, wherein the cooling agent is a gas coolant.

9. An internally-cooled centrifugal compressor diaphragm, comprising: a rotatable impeller centrally-disposed within the internally-cooled centrifugal compressor diaphragm; a diffuser fluidly coupled to an outlet of the rotatable impeller and having a plurality of diffuser vanes arranged therein, each diffuser vane having at least one diffuser conduit defined therein; a return channel fluidly coupled to the diffuser and having a plurality of return channel vanes arranged therein, each return channel vane having at least one return conduit defined therein; a cooling jacket proximally-located about the diffuser and the return channel, the cooling jacket having a first chamber and a second chamber; and a center bulb defined within the internally-cooled centrifugal compressor diaphragm and interposed between the diffuser and the return channel, the center bulb including a plenum in fluid communication with the first chamber via the at least one return conduit and in fluid communication with the second chamber via the at least one diffuser conduit.

10. The internally-cooled centrifugal compressor diaphragm of claim 9, wherein the return conduits and/or the diffuser conduits are coarsely threaded.

11. The internally-cooled centrifugal compressor diaphragm of claim 9, wherein the first chamber and/or the second chamber have a plurality of structural vanes arranged therein.

12. The internally-cooled centrifugal compressor diaphragm of claim 11, wherein the structural vanes provide structural support for the internally-cooled centrifugal compressor diaphragm.

13. The internally-cooled centrifugal compressor diaphragm of claim 11, wherein the structural vanes introduce turbulence to a cooling agent flowing therein.

14. The internally-cooled centrifugal compressor diaphragm of claim 9, wherein the diffuser and the return channel are smooth-walled structures.

* * * * *